US007421841B2

(12) United States Patent
Yueh

(10) Patent No.: US 7,421,841 B2
(45) Date of Patent: Sep. 9, 2008

(54) THREE-SHIFT LIFTING MECHANISM FOR JACK OR THE LIKE

(75) Inventor: Ming Chuan Yueh, Chia-I Hsien (TW)

(73) Assignee: Shinn Fu Corporation, Taipei (TW)

( * ) Notice: Subject to any disclaimer, the term of this patent is extended or adjusted under 35 U.S.C. 154(b) by 520 days.

(21) Appl. No.: 11/147,278

(22) Filed: Jun. 8, 2005

(65) Prior Publication Data

US 2005/0226744 A1 Oct. 13, 2005

Related U.S. Application Data

(63) Continuation-in-part of application No. 10/667,660, filed on Sep. 23, 2003, now Pat. No. 6,923,431.

(51) Int. Cl.
*B66F 3/24* (2006.01)
*B66F 5/00* (2006.01)

(52) U.S. Cl. ..... 60/477; 254/8 B; 254/93 R; 254/93 H

(58) Field of Classification Search ..... 60/477, 60/479, 481, 482; 91/517, 519; 254/8 B, 254/93 H, 93 R
See application file for complete search history.

(56) References Cited

U.S. PATENT DOCUMENTS 3,806,091 A * 4/1974 Wride ..... 60/479
6,035,635 A * 3/2000 Hung ..... 60/479
6,581,909 B2 * 6/2003 Wixey ..... 254/8 B
6,923,431 B2 * 8/2005 Yueh ..... 254/93 H

* cited by examiner

*Primary Examiner*—Thomas E Lazo
(74) *Attorney, Agent, or Firm*—Bacon & Thomas, PLLC

(57) ABSTRACT

The load dependent, variable displacement, at least three-shift hydraulic mechanism includes a hydraulic device disposed at the front side of a valve block and adapted to move a ram piston oriented such as to raise weight, the hydraulic device defining an oil accumulation chamber, a rapid-lifting oil chamber for rapid extension of the ram piston under no-load conditions, and a high-pressure oil chamber for lifting the ram piston oriented to raise weights, a pump piston apparatus disposed at the back side of the valve block and defining a front working chamber and a rear oil accumulation chamber, and oil passages so arranged that hydraulic oil can be supplied from the oil accumulation chamber and the rear oil accumulation chamber to the front working chamber and then to the rapid-lifting oil chamber or the high-pressure oil chamber to extend the ram piston.

8 Claims, 12 Drawing Sheets

THREE-SHIFT LIFTING MECHANISM FOR JACK OR THE LIKE

CROSS-REFERENCE TO RELATED APPLICATION

This is a CIP application of Ser. No. 10/667,660, filed Sep. 23, 2003, entitled "THREE-SHIFT LIFTING MECHANISM FOR JACK OR THE LIKE".

BACKGROUND OF THE INVENTION (a) Field of the Invention

The present invention relates to lifting mechanisms whose load engaging member is adapted to raise weights and, more particularly, to a load dependant, variable displacement jacking mechanism providing at least 3 shifts in performance characteristic relating to the effort expended by the operator and how quickly the lift mechanism and/or the load is raised. Each of the 3 performance characteristics form an operator felt response to the act of raising the lift arm and the load.

- the first shift/response is one of minimal handle pumping effort as the operator raises a substantially unloaded lifting member quickly to contact the load;
- the second shift/response is one of greater than minimal pumping effort as the user raises a considerably less than rated capacity load at a slightly slower raising speed, but significantly more rapid than if the load were rated capacity;
- the third shift/response is one of minimal operator effort to raise a significantly greater load but at slower raising speed than the previous response.

(b) Description of the Prior Art

A lifting mechanism using a conventional hydraulic device for use in a vehicle jack or the like is generally comprised of a valve block containing check valves and passages communicating to a ram piston apparatus and a pump piston apparatus. The pump piston is actuated by a means to suck in hydraulic oil and then to pump hydraulic oil through passages and valving into a lifting tube, causing the ram piston to extend, thereby acting upon the lifting mechanism, causing it to rise. This device has limitations due to the felt response of the operator to the pumping action of the actuator means, i.e. a single slow raising speed whether the lifting mechanism is loaded or unloaded so that the user employs much effort to repeatedly reciprocate the pump piston and the operator expends much actuator pumping effort when the lifting mechanism finally contacts the load. There are known, dual-speed lifting mechanisms that enable the ram piston apparatus to engage the load quickly from a fully retracted lift mechanism position and then continued pumping results in raising the load at a slow speed. However, these dual speed mechanisms have no means of enabling the operator to raise substantially lesser that rated capacity loads quickly, promoting both poor lift performance and operator fatigue. Therefore, it is desirable to provide three stages of felt response in order to eliminate the drawbacks of the conventional lifting mechanism.

SUMMARY OF THE INVENTION

The present invention has been accomplished under the circumstances in view. It is the main object of the present invention to provide a load dependant, variable displacement mechanism which provides at least three stages of lift performance and felt response to same; the first felt response is one of minimal handle pumping effort as the operator raises a substantially unloaded lifting member quickly to contact the load; the second felt response is one of greater than minimal pumping effort as the user raises a considerably less than rated capacity load at a slightly slower raising speed, but significantly more rapid than a load representing rated capacity; the third felt response is one of minimal operator effort to raise a significantly greater load but at a slower raising speed than the previous responses.

To achieve this and other objects of the present invention, the three-stage lift performance lifting mechanism comprises a hydraulic device comprising a cylindrical casing, a barrel, a ram piston tube, a small tube moveably oriented substantially within the ram piston tube, the casing being a double open end member axially inserted into the inside of the casing and defining within the casing an oil reservoir chamber in between the barrel and the casing, the ram piston tube having an opening and axially mounted in the barrel and forwardly extended out of the casing and adapted to raise the lifting mechanism, the ram piston tube having an axially extending center hole to a rear open side thereof, a piston ring disposed at the periphery thereof near the rear open side and pressed on an inside wall of the barrel, and a high-pressure oil chamber defined within the barrel behind the piston ring, the small tube moveably oriented substantially within the ram piston tube being a double open sided tube inserted into the axial center hole inside the ram piston tube and defining therein a rapid-lifting oil chamber; a pump piston adapted to pump hydraulic oil into the hydraulic device to extend the ram piston, a pump piston comprising a housing and a plunger axially slidably mounted in the housing, the housing being a hollow cylindrical member having at least one oil hole positioned through the periphery thereof in communication with the inside space thereof, the plunger comprising a piston of relatively bigger diameter disposed at the front side inside the housing and a piston rod of relatively smaller diameter disposed at a rear side and extending out of the housing, said piston having a plurality of annular flanges extended around the periphery thereof and pressed on an inside wall of the housing and defining the inside space of the housing into a front working chamber and a rear oil accumulator chamber, the piston having an oil hole axially backwardly extended from the center of a front side thereof then directed sideways to the periphery thereof in communication between the front working chamber and the rear oil accumulator chamber, and a one-way valve means comprising a spring member, a steel ball, a ball seat and mounted in the oil hole of the piston to control one-way flow of hydraulic oil from the rear oil accumulator chamber to the front working chamber; and a valve block adapted to accommodate the hydraulic device and the piston pump, the valve block comprising a front coupling flange fitted into a rear open side of the cylindrical casing, a recessed portion disposed at the center of the front coupling flange and adapted to accommodate the barrel and the small center tube, a receiving hole adapted to accommodate the piston pump and to block the front working chamber, a first oil passage extended from the oil accumulation chamber to the front working chamber, a second oil passage extended from the front working chamber to the high-pressure oil chamber and the rapid-lifting oil chamber, a third oil passage extended from the oil accumulation chamber to the high-pressure oil chamber, a fourth oil passage extended from the oil accumulation chamber to the rear oil accumulation chamber, a fifth oil passage shunted from the second oil passage and extended to the rear buffer chamber, a sixth oil passage extended from the rapid lifting oil chamber to the oil accumulation chamber, and a seventh oil passage extended from the high-pressure oil chamber to the oil accumulation chamber.

By means of the aforesaid arrangement, hydraulic oil is supplied from the rear oil accumulation chamber and the oil reservoir chamber to the front working chamber for pumping to the rapid-lifting oil chamber producing performance characteristics which are load dependent; one of minimal handle pumping effort as the operator raises a substantially unloaded lifting member quickly to contact the load;

OR for pumping to the rapid-lifting oil chamber and to the high-pressure oil chamber through one of at least 3 preset pressure relief valves. An additional benefit is that during the pumping of hydraulic oil into the high-pressure oil chamber through one or more preset pressure relief valves, hydraulic oil is simultaneously guided into the rear oil accumulation chamber of the pump piston for enabling the front working chamber to suck in hydraulic oil from the rear oil accumulation chamber and the oil accumulation chamber enabling a more efficient pumping action.

DETAILED DESCRIPTION OF THE PREFERRED EMBODIMENTS

Figure 1:
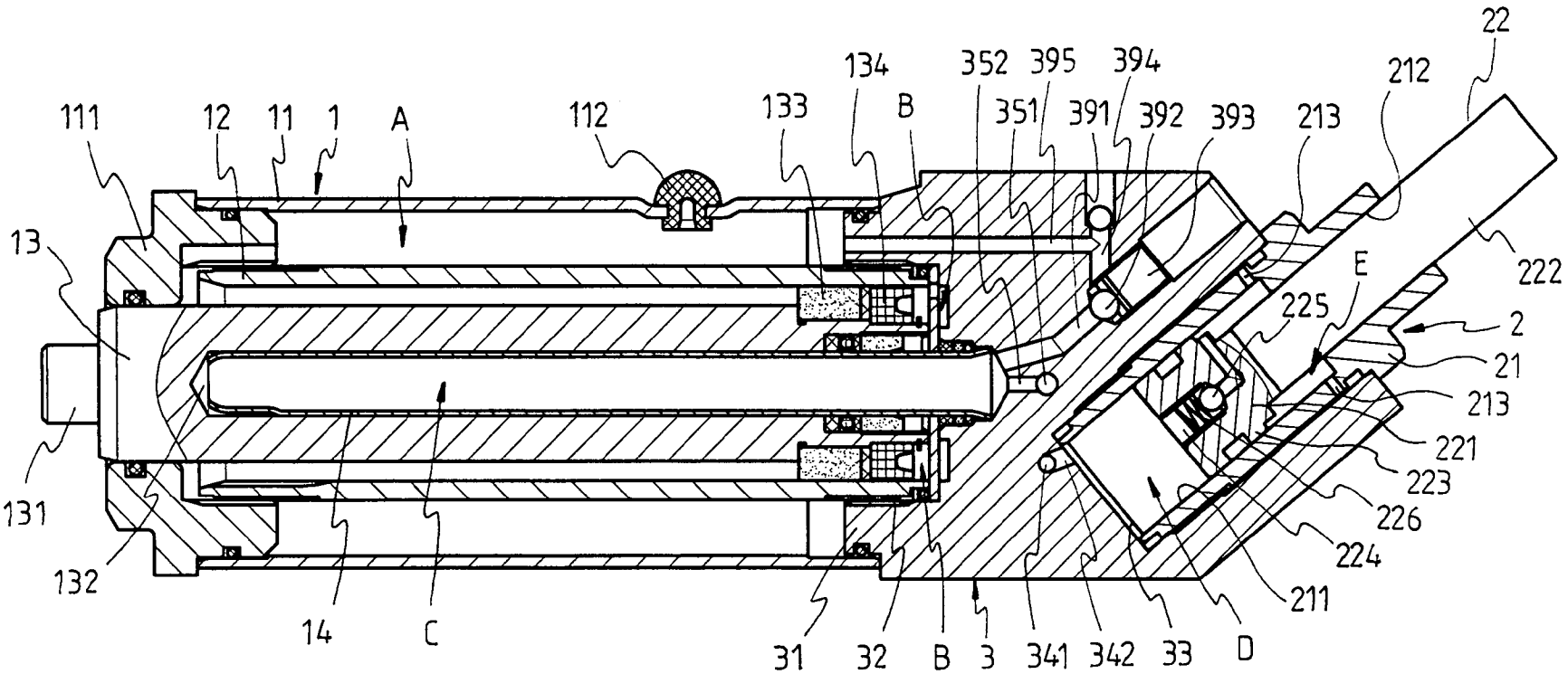
FIG. 1 is a sectional view of a 3 stage hydraulic lifting mechanism according to the present invention.
Figure 2:
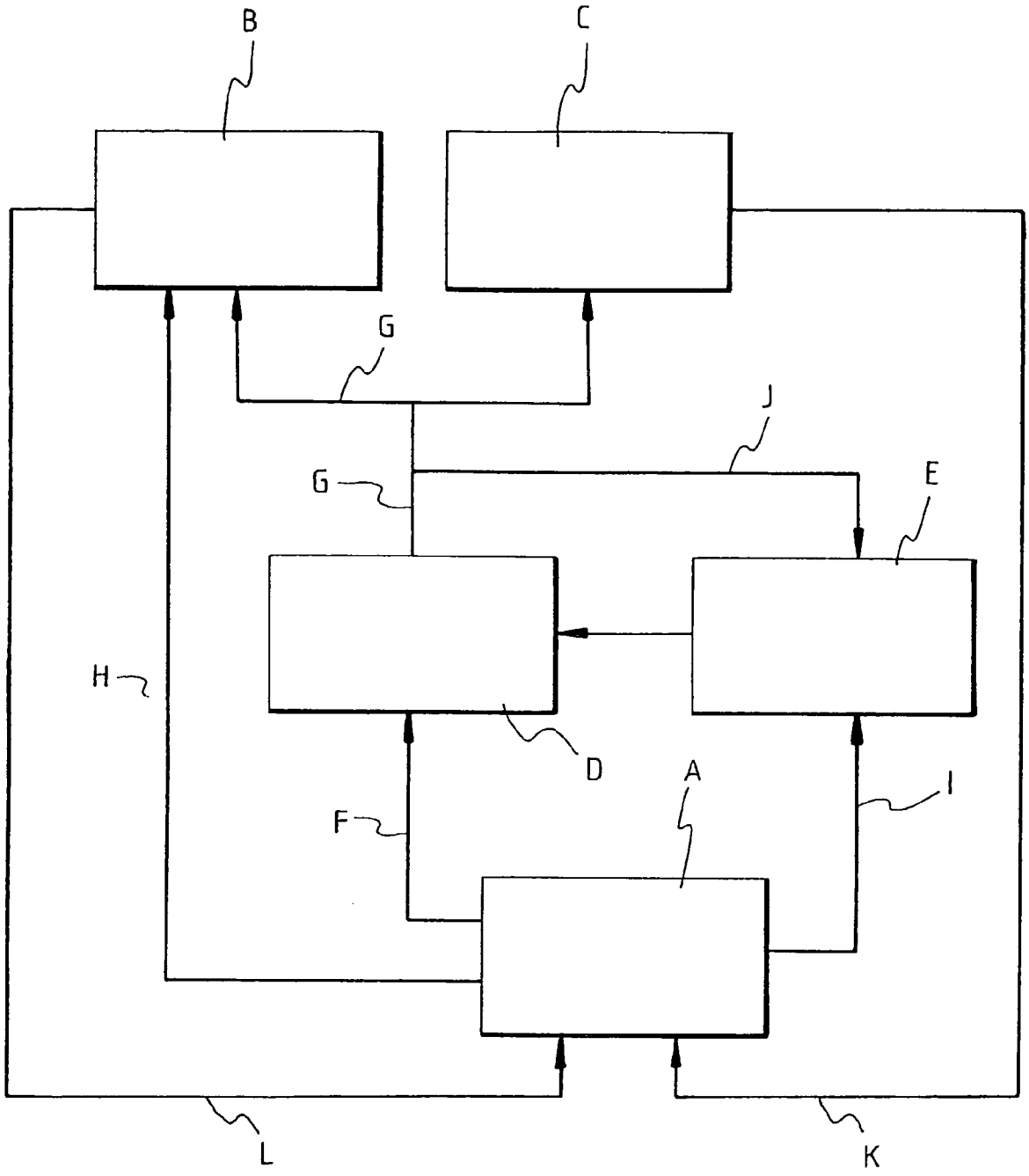
FIG. 2 is a block diagram showing the linking of the oil chambers and oil passages according to the present invention.
Figure 3:
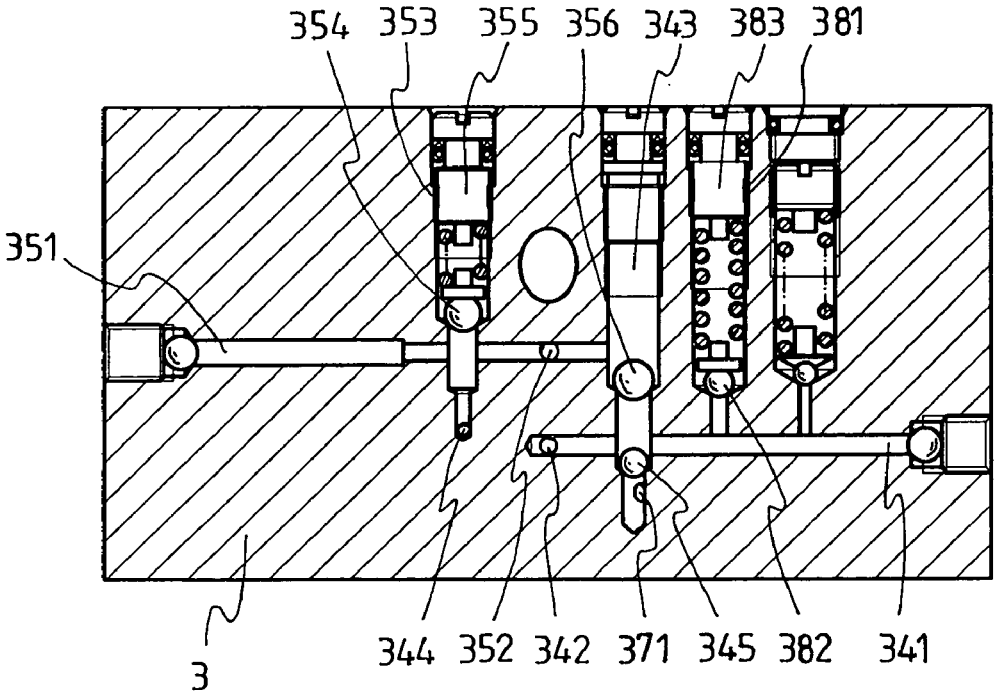
FIG. 3 is a sectional view of the valve block according to the present invention.
Figure 18:
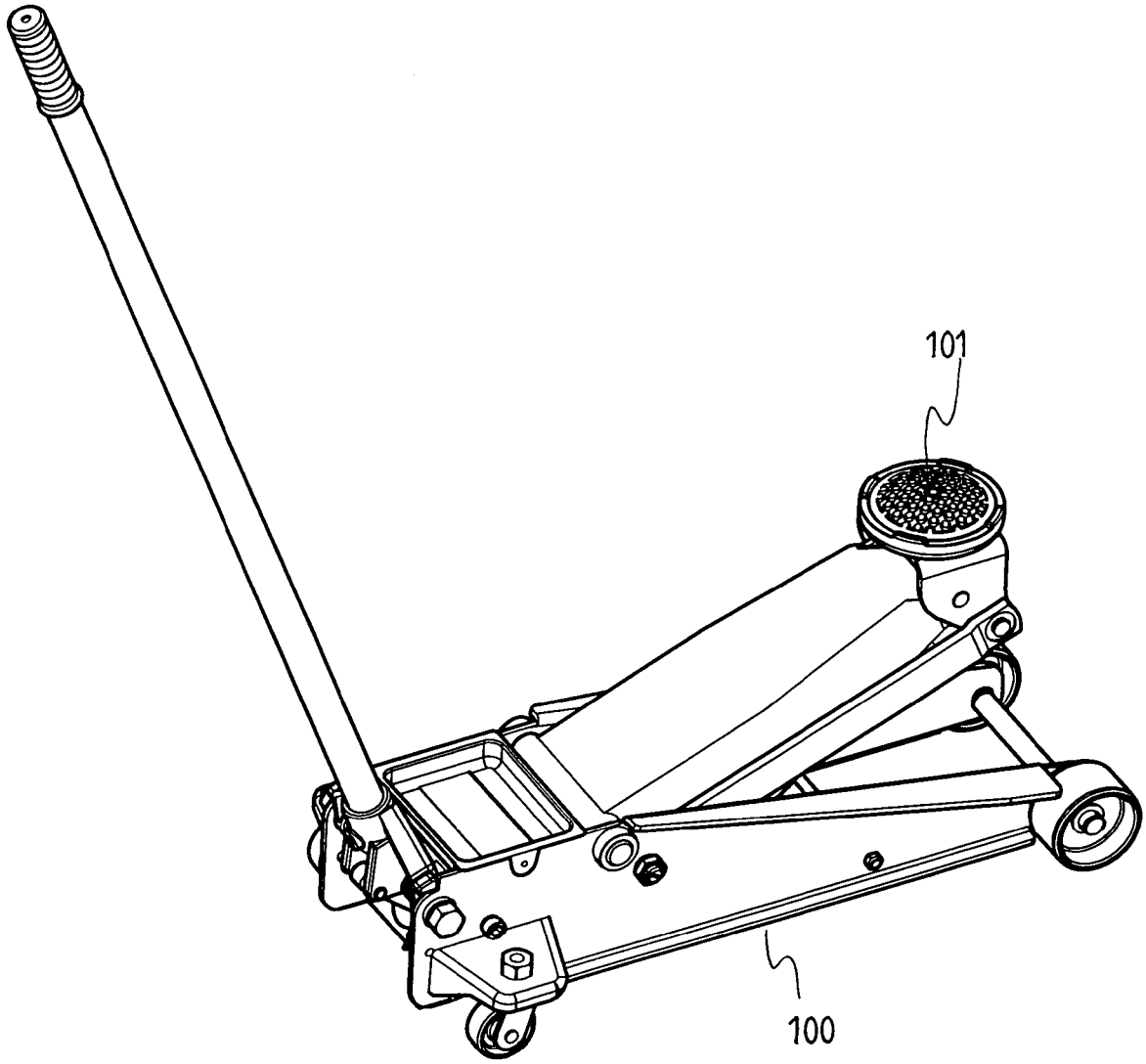
FIG. 18 (does not appear at all) shows the three-stage lifting mechanism used in a jack according to the present invention.

Referring to FIGS. 1~3, a load dependent, variable displacement, at least three-shift lifting mechanism in accordance with the present invention can be installed in a jack (see FIG. 18) or used directly to lift weights, comprising a hydraulic device 1, a pump piston apparatus 2, and a valve block 3. The hydraulic device 1 (see FIG. 1) comprises a cylindrical casing 11, a barrel 12, a ram piston 13, and a small center tube 14. The casing 11 is a double open end cylinder having the front side mounted to an oil seal ring containing member 111 and the periphery provided with a stopper 112. The barrel 12 is a double open end member axially inserted into the inside of the casing 11, having the front open side in communication with the casing 11 via the oil seal ring within 111. An oil accumulation chamber (reservoir) A is defined between the casing 11 and the barrel 12. The lifting tube 13 is a one open side tube adapted to engage the bearing pan 101 of the jack 100, having front coupling rod 131 axially forwardly extended from the front closed side and coupled to the bearing pan 101 of the jack 100, an axial center hole 132 axially extended to the rear open side, a piston ring 133 disposed at the periphery near the rear open side, and a locating device 134 disposed at the periphery adjacent to the piston ring 133. The lifting tube 13 is axially mounted in the barrel 12, keeping the front coupling rod 131 disposed outside the oil seal ring within 111 and the piston ring 133 pressed on the inner diameter of the barrel 12. Therefore, a high-pressure oil chamber B is defined within the barrel 12 behind the piston ring 133. Hydraulic oil can be pumped into the high-pressure oil chamber B to drive the lifting tube to lift the load.

Figure 7:
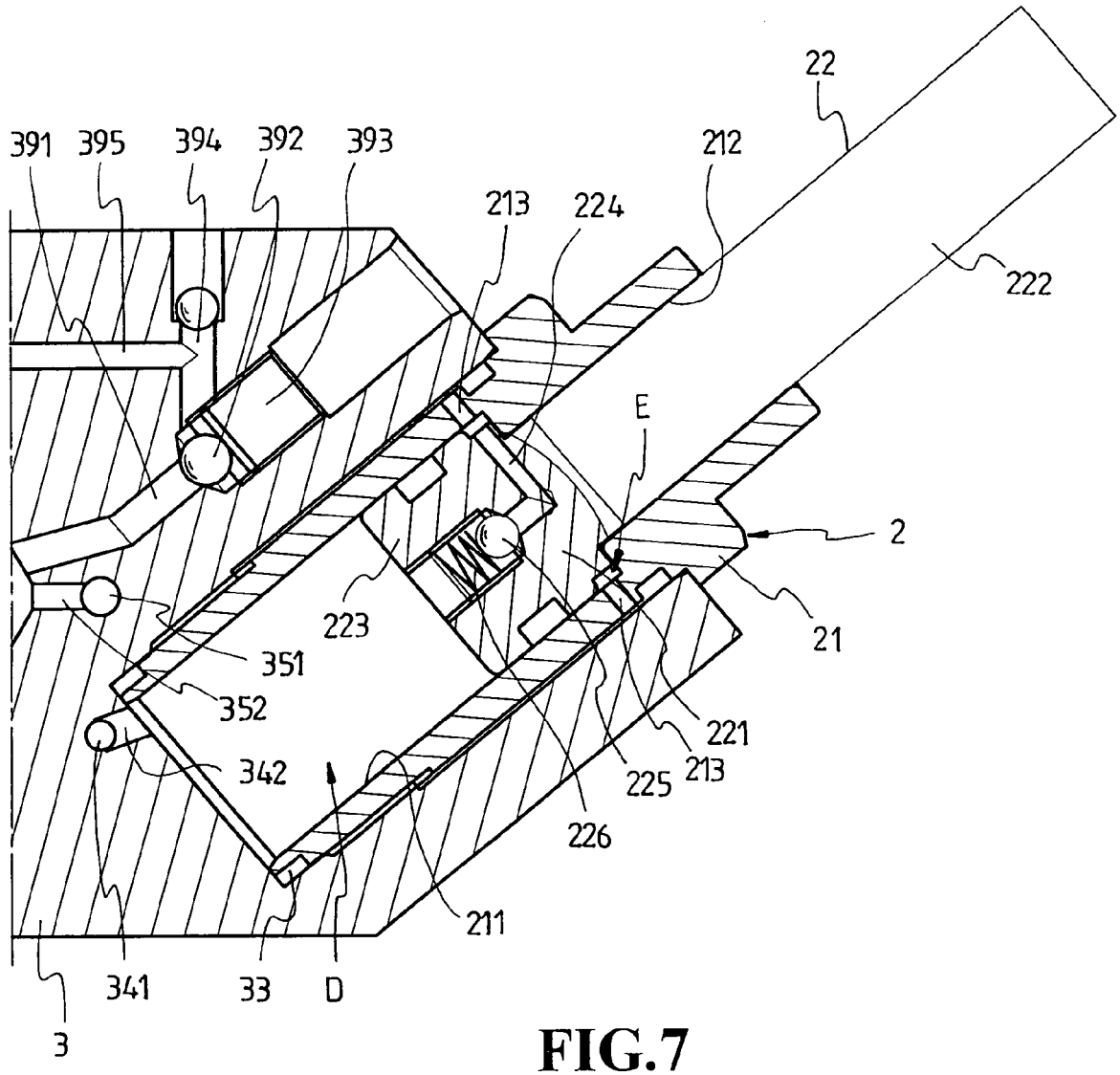
FIG. 7 is a sectional view of the pump piston apparatus according to the present invention.

The small center tube 14 is a double open side tube inserted into the axial center hole 132 inside the lifting tube 13, defining therein a rapid-lifting oil chamber C into which hydraulic oil is pumped to lift the lifting tube 13 rapidly. The pump piston 2 (see FIGS. 1 and 7) is provided for operation by the user to pump hydraulic oil into the hydraulic device 1 to extend the lifting tube. The pump piston comprising a housing 21 and a plunger 22. The housing 21 is a hollow cylindrical member having a front oil chamber 211, a plunger hole 212 in communication with the bottom side of the front oil chamber 211, and a plurality of oil holes 213 cut through the periphery in communication with the front oil chamber 211. The plunger 22 is axially slidably mounted in the housing 21, having a piston 221 of relatively bigger diameter disposed at the front side inside the oil chamber 211 and a piston rod 222 of relatively smaller diameter disposed at the rear side and extended out of the rear side of the housing 21. The piston 221 has a plurality of annular flanges 223 extended around the periphery and provided on the peripheral wall of the oil chamber (i.e., the inner diameter of the housing 21). Therefore the piston 221 divides the oil chamber 211 into a front working chamber D and a rear oil accumulation chamber E. Further, the piston 221 has an oil hole 224 axially backwardly extended from the center of the front side, then turned sideways to the periphery in communication between the front working chamber D and the rear working chamber E, a one-way valve formed of a spring member 226 and a steel ball 225 and mounted in the oil hole 224 to control one-way flowing of hydraulic oil from the rear working chamber E to the front working chamber D.

The valve block 3 (see FIGS. 1 and 2) is mounted inside the jack 100 and adapted to accommodate the hydraulic device 1 and the piston pump 2 and to link the oil accumulation chamber A, the high-pressure oil chamber B, the rapid-lifting oil chamber C, the front working chamber D, rear working chamber E. The valve block 3 comprises a front coupling flange 31 fitted into the rear open side of the cylindrical casing 11, a recessed portion 32 disposed at the center of the front coupling flange 31, which receives the barrel 11 and the small center tube 14, a rear receiving hole 33, which accommodates the pump piston apparatus 2 and blocks the front working chamber D, a first oil passage F extended from the oil accumulation chamber A to the front working chamber D, a second oil passage G extended from the front working chamber D to the high-pressure oil chamber B and the rapid-lifting oil chamber C, a third oil passage H extended from the oil accumulation chamber A to the high-pressure oil chamber B, a fourth oil passage I extended from the oil accumulation chamber A to the rear working chamber E, a fifth oil passage J shunted from the second oil passage G and extended to the rear working chamber E, a sixth oil passage K extended from the rapid-lifting oil chamber C to the oil accumulation chamber A, and a seventh oil passage L extended from the high-pressure oil chamber B to the oil accumulation chamber A.

As indicated above, the first oil passage F extends from the oil accumulation chamber A to the front working chamber D. As shown in FIGS. 1 and 3, the first oil passage F is formed of a first transverse oil hole 341, an oil hole 342 extended from the bottom end of the first transverse oil hole 341 to the rear receiving hole 33 (i.e., the front working chamber D of the housing 21), a stepped first longitudinal oil hole 343 extended across the first transverse oil hole 341, an oil hole 344 extended from the bottom end of the stepped first longitudinal oil hole 343 to the front side of the valve block 3 in communication with the oil accumulation chamber A of the barrel 11, and a one-way valve formed of a steel ball 345 mounted in the first stepped longitudinal oil hole 343 and stopped between the oil hole 344 and the oil hole 342. Upon upstroke of the pump piston 2, hydraulic oil is pumped out of the oil accumulation chamber A to push the steel ball 345 out of position and then to pass to the front working chamber D.

Figure 4:
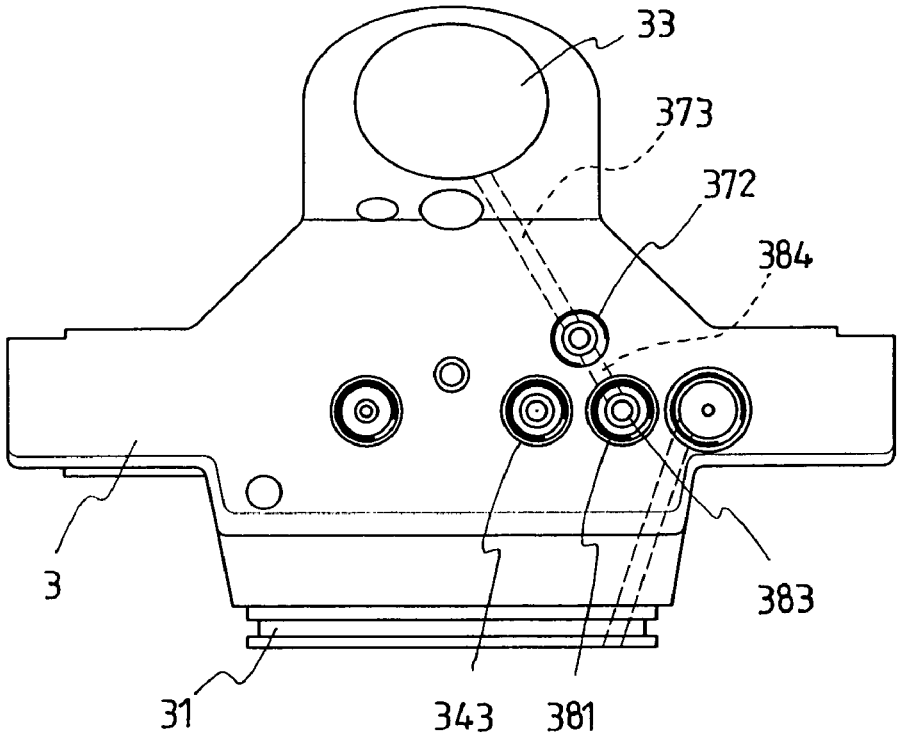
FIG. 4 is a top view of the valve block according to the present invention.

As indicated above, the second oil passage G extends from the front working chamber D to the high-pressure oil chamber B and the rapid-lifting oil chamber C. As shown in FIGS. 1, 3, and 4, the second oil passage G is formed of a second transverse oil hole 343, an oil hole 352 extended from the second transverse oil hole 351 to the rapid-lifting oil chamber C (see FIG. 1), a second longitudinal oil hole 353 extended across the second transverse oil hole 353 and works as a one-way valve means, a pressure regulator 355 disposed at the top end of the second longitudinal oil hole 353, an oil hole (not shown) extended from the second longitudinal oil hole 353 to the high-pressure oil chamber B, a steel ball 356 mounted in the first longitudinal oil hole 343 between the first transverse oil hole 341 and the second transverse oil hole 351. Upon down (compression) stroke of the pump piston apparatus 2, hydraulic oil passes out of the front working chamber D to push open the steel ball 356 and to pass to the inside of the rapid-lifting oil chamber C, or to further push open the steel ball 354 and the pressure regulator 355 and then to pass to the inside of the high-pressure oil chamber B, and therefore the lifting tube 13 and lifting mechanism is rapidly moved to the weights (1st Stage), or forced to lift the weights (2nd Stage).

Figure 5:
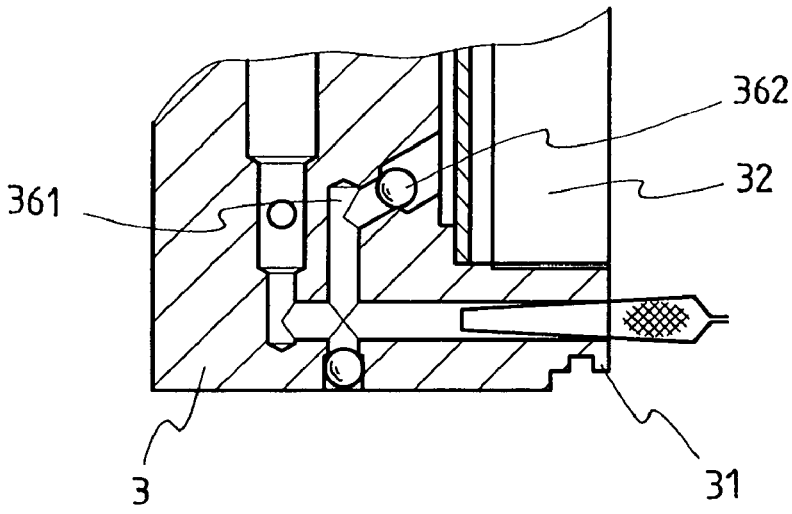
FIG. 5 is a sectional view of the third oil passage according to the present invention.

As indicated above, the third oil passage H extends from the oil accumulation chamber A to the high-pressure oil chamber B. As shown in FIGS. 2 and 5, the third oil passage H comprises a curved hole 361 extended from the front side of the front coupling flange 31 of the valve block 3 to the recessed portion 32, a steel ball 362 mounted in the oil hole 361 and worked as a one-way valve means. During rapid extension of the lifting tube (ram piston) 13, hydraulic oil is supplied from the oil accumulation chamber A to fill up the high-pressure oil chamber B for further pumping by the pump piston apparatus 2 to forcefully extend the lifting tube 13, thereby raising the weights.

Figure 6:
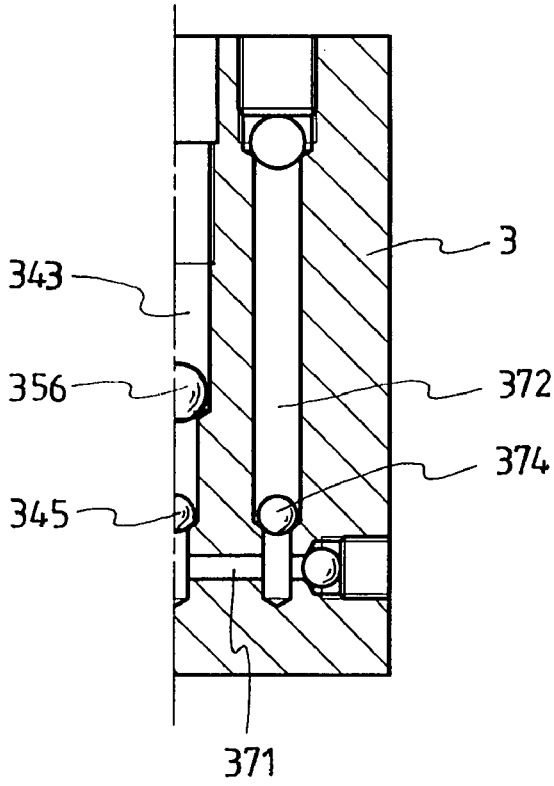
FIG. 6 is a sectional view of the fourth oil passage according to the present invention.

As indicated above, the fourth oil passage I extends from the oil accumulation chamber A to the rear oil accumulation chamber E. As shown in FIGS. 2, 4, and 6, the fourth oil passage I comprises an oil hole 371 shunted from the first longitudinal oil hole 343 below the steel ball 345, a third longitudinal oil hole 372 disposed inside the valve block 3 and across the oil hole 371, an oil hole 373 extended from the third longitudinal oil hole 372 to the rear receiving hole 33, a steel ball 374 mounted in between the oil hole 372 and the oil hole 373 and working as one-way valve means. Further, by means of the oil holes 213 and the housing 21, the oil hole 373 is in fluid communication with the rear oil accumulation chamber E. Upon down stroke of the pump piston apparatus 2, hydraulic oil is sucked from the oil accumulation chamber A into the rear oil accumulation chamber E.

As indicated above, the fifth oil passage J is shunted from the second oil passage G and extended to the rear oil accumulation chamber E. As shown in FIGS. 2~4, the fifth oil passage J is formed of a fourth longitudinal oil hole 381 in fluid communication with the first transverse oil hole 341, a steel ball 382 mounted in the fourth longitudinal oil hole 381 and working as a one-way valve means, a pressure regulator 383 mounted in the fourth longitudinal oil hole 381 above the steel ball 382, an oil hole 384 in fluid communication between the fourth longitudinal oil hole 381 and the third longitudinal oil hole 372. Upon an overload at the lifting tube 13, a quantity of hydraulic fluid passes through the fifth oil passage J to the rear oil accumulation chamber E, and a quantity of hydraulic oil pushes open the steel ball 354 and the pressure regulator 355 and then passes to high-pressure oil chamber B to extend the lifting tube 13 more slowly than 1st and 2nd stage and substantially reducing operator pumping effort (third stage).

As indicated above, the sixth oil passage K extends from the rapid-lifting oil chamber C to the oil accumulation chamber A. As shown in FIGS. 1 and 2, the sixth oil passage K is formed of an oil hole 391 disposed at the recessed portion 32 of the valve block 3, a steel ball 392 mounted in the oil hole 391 and working as one-way valve means for enabling hydraulic oil to pass from the rapid-lifting oil chamber C to the oil accumulation chamber A, a pressure regulator 393 mounted in the oil hole 391 above the steel ball 392, an oil hole 394 in fluid communication with the oil hole 391, an oil hole 395 extended from the oil hole 394 to the front side of the front coupling flange 31 in fluid communication with the oil accumulation chamber A. Upon return stroke of the lifting tube 13, hydraulic oil return from the rapid-lifting oil chamber C to the oil accumulation chamber A.

Figure 8:
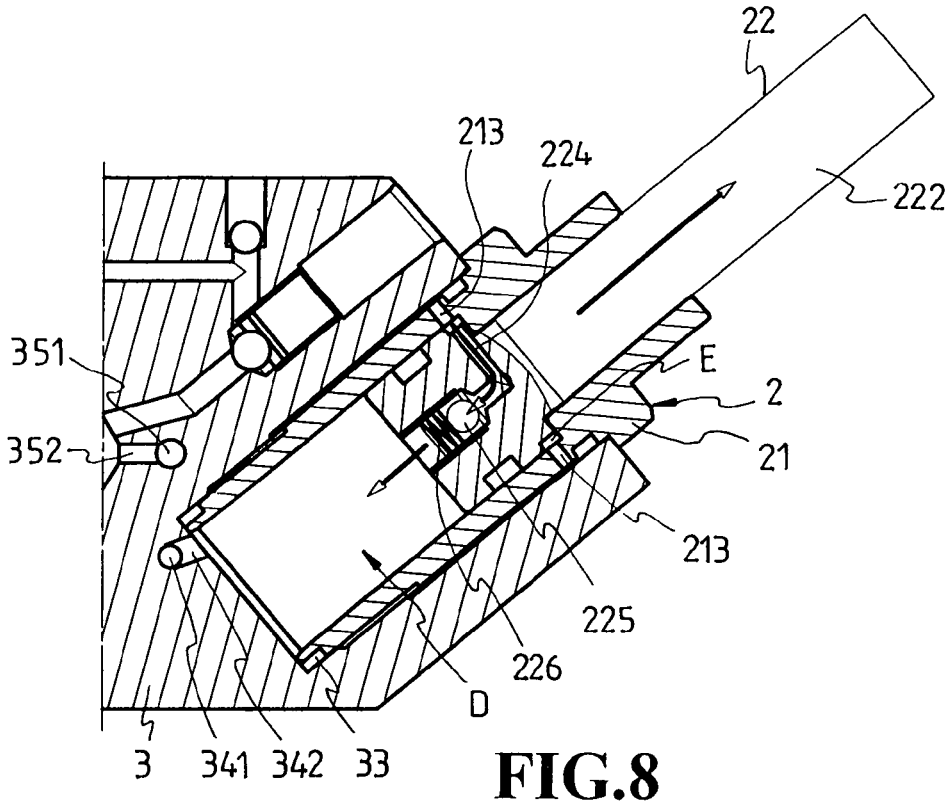
FIG. 8 is a schematic drawing showing the action of the pump piston apparatus according to the present invention (I).
Figure 9:
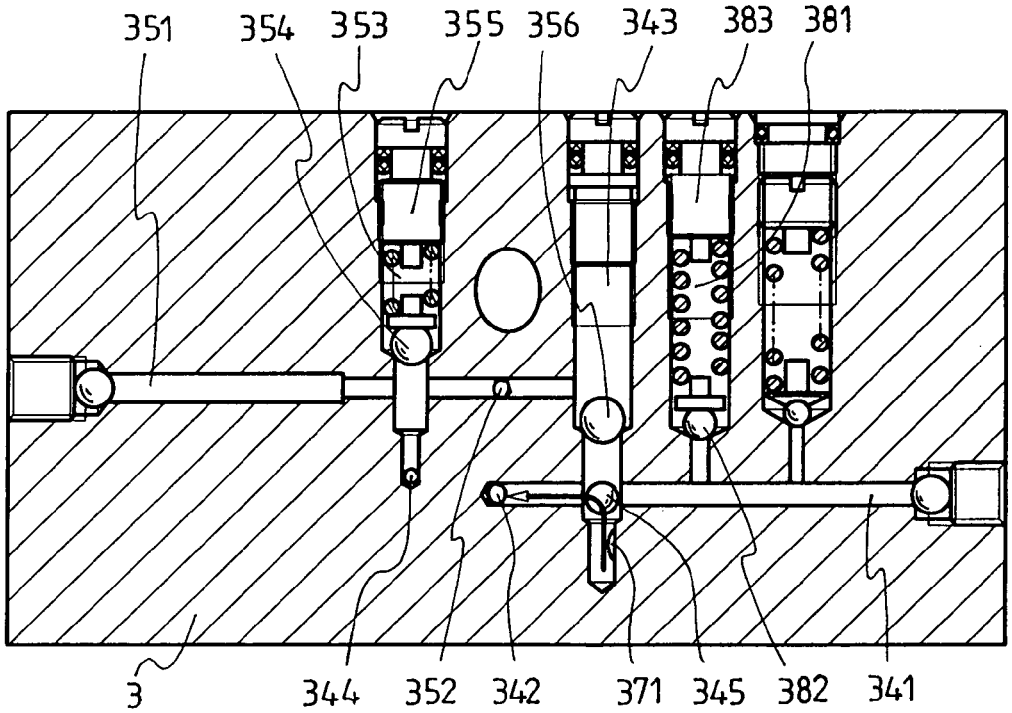
FIG. 9 is a schematic drawing showing the action of the pump piston apparatus according to the present invention (II).
Figure 10:
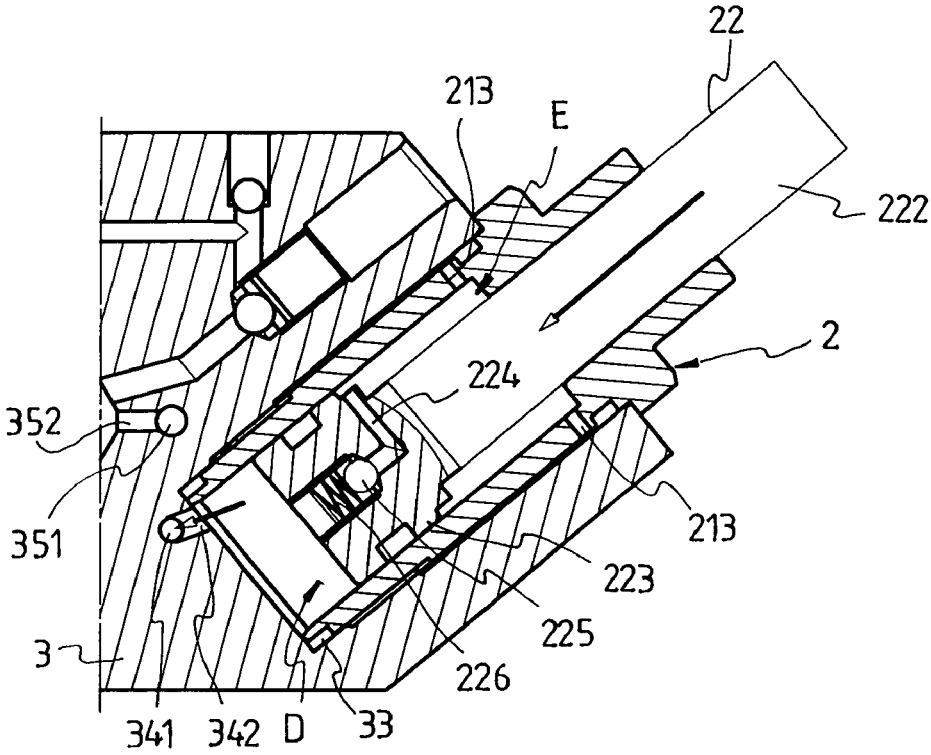
FIG. 10 is a schematic drawing showing hydraulic oil pumped into the second oil passage according to the present invention.
Figure 11:
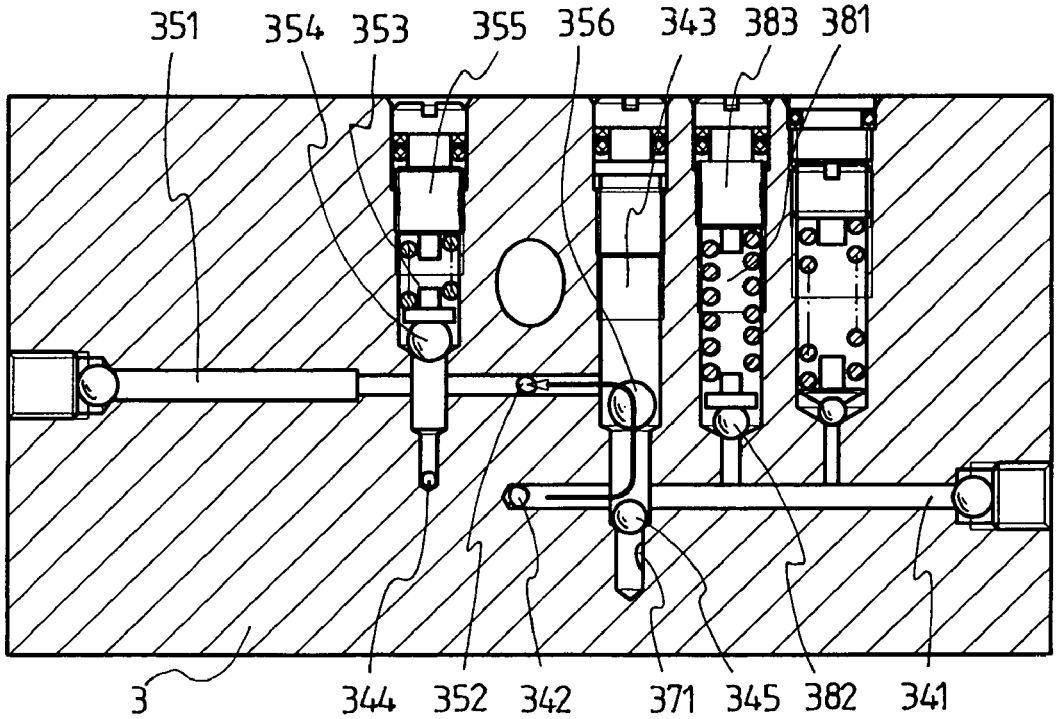
FIG. 11 is a schematic drawing showing hydraulic oil pumped into the rapid-lifting oil chamber according to the present invention.
Figure 12:
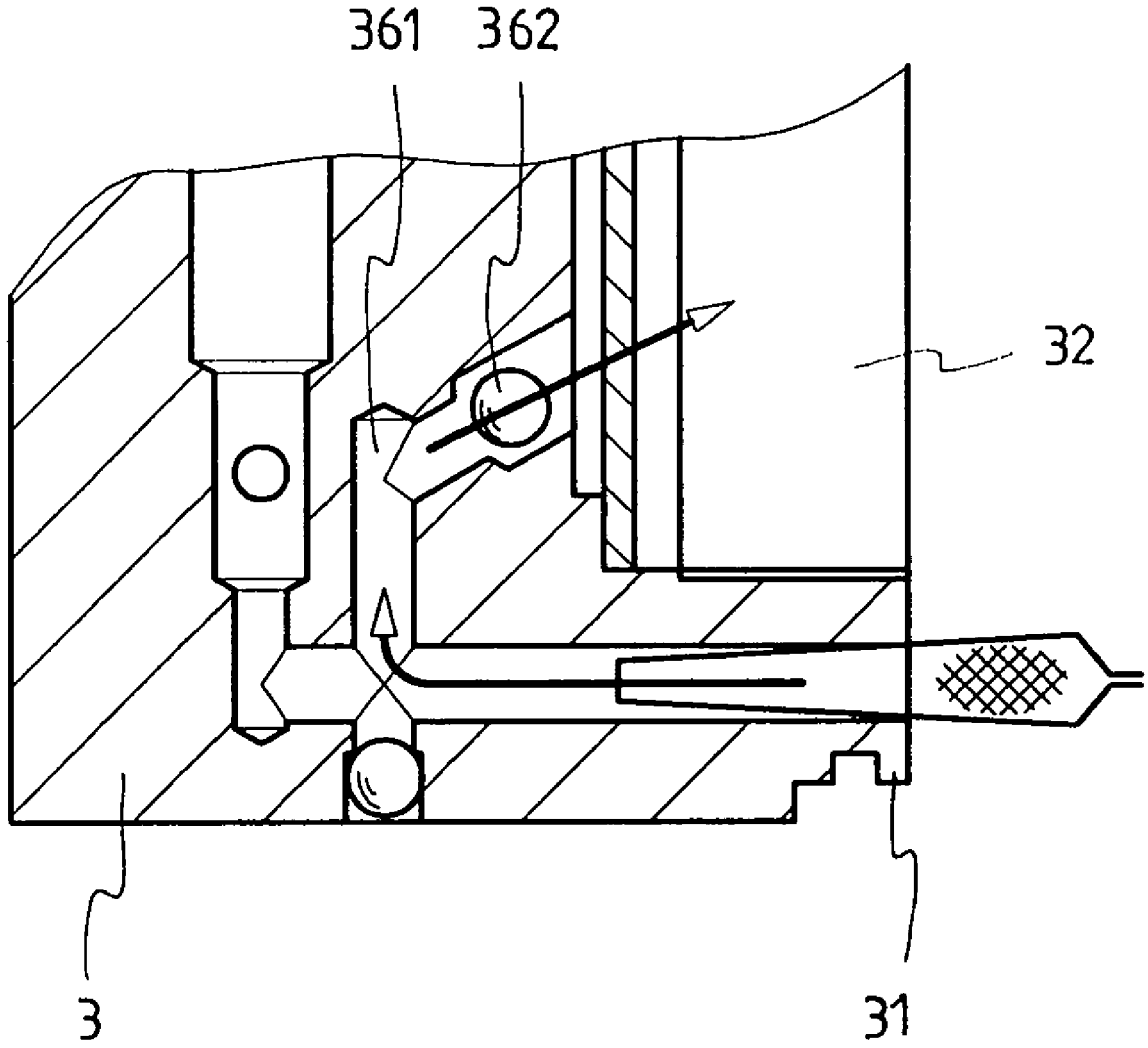
FIG. 12 is a schematic drawing showing hydraulic oil supplied from the oil accumulation chamber to the high-pressure oil chamber according to the present invention.
Figure 13:
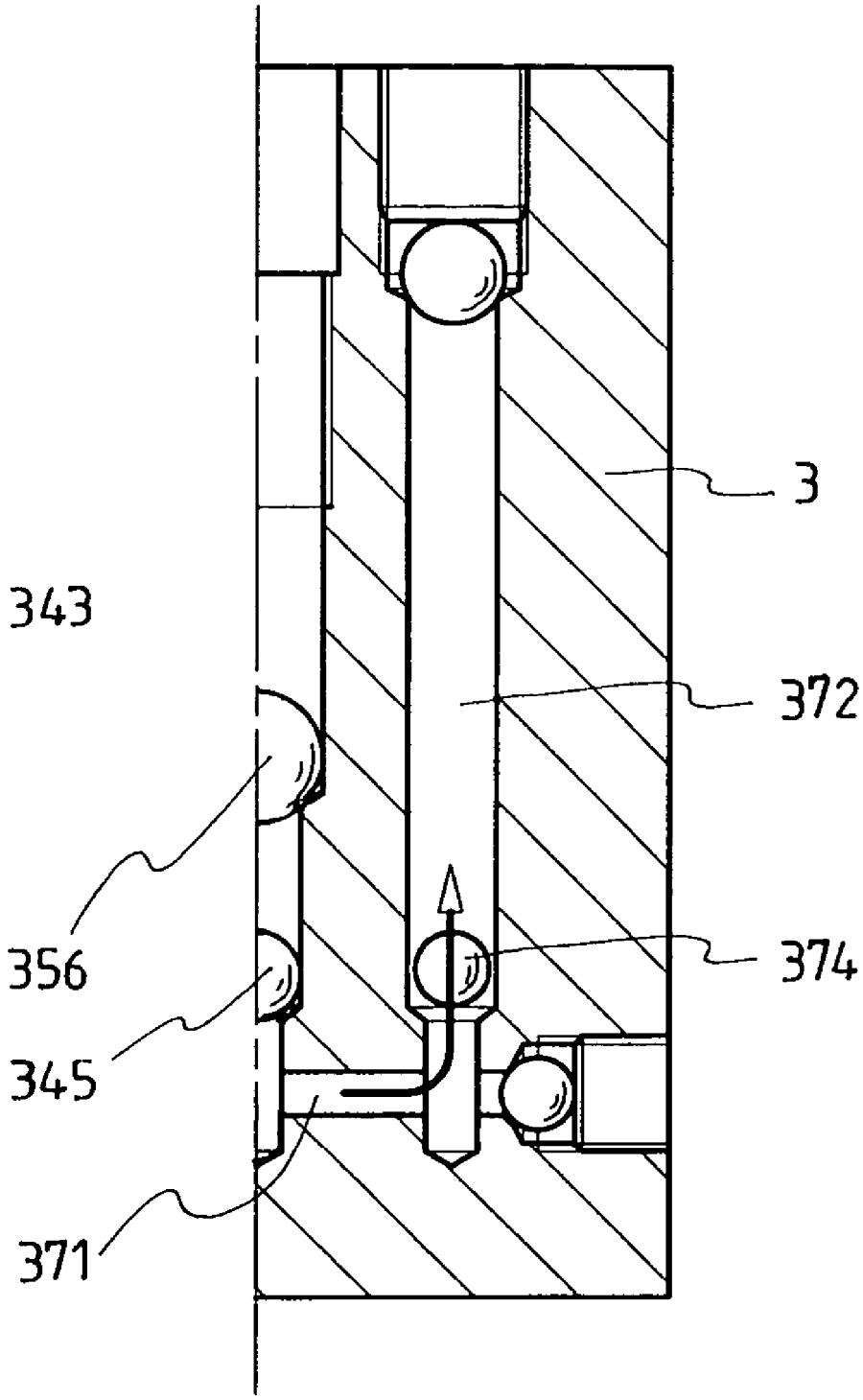
FIG. 13 is a schematic drawing showing hydraulic oil supplied from the oil accumulation chamber to the rear oil accumulation chamber according to the present invention.
Figure 16:
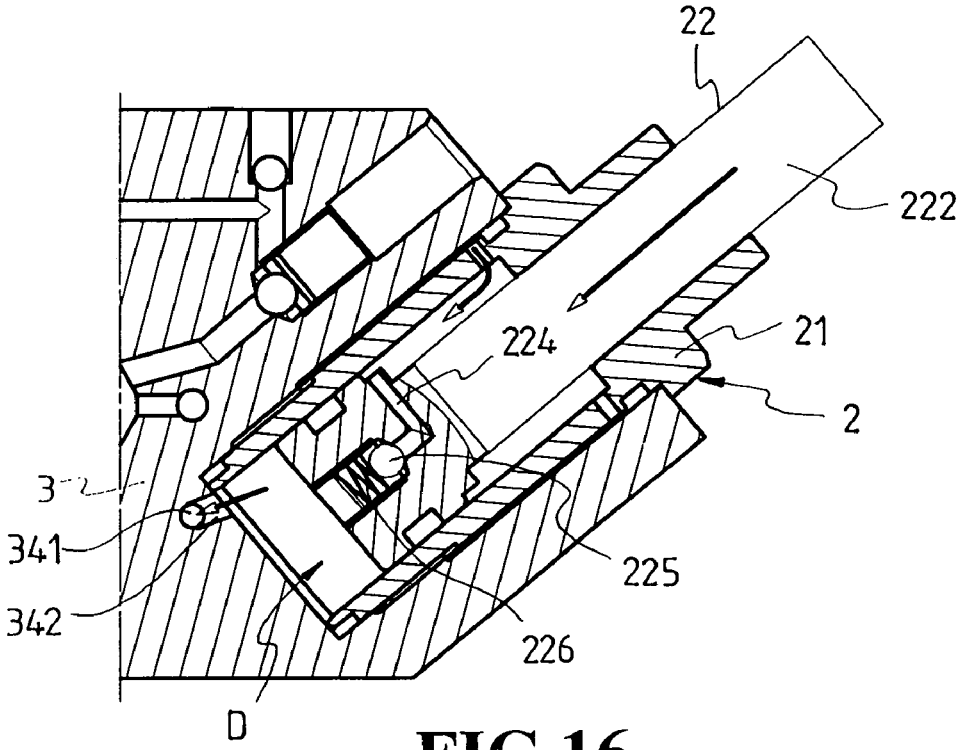
FIG. 16 is a schematic drawing showing hydraulic oil flow into the rear oil accumulation chamber according to the present invention.

As indicated above, the seventh oil passage L extends from the high-pressure oil chamber B to the oil accumulation chamber A (see FIG. 2). The seventh oil passage L is an oil hole having one-way valve means, for example, a steel ball is mounted therein to control the flowing direction of hydraulic oil. Upon return stroke of the lifting tube (ram piston) 13, hydraulic oil flows backwards from the high-pressure oil chamber B to the oil accumulation chamber A via the seventh oil passage L. As an application example of the present invention, the 3-stage lifting mechanism is used in a jack 100 and operated as follows:

1. First Stage, i.e., rapid movement of the lifting tube 13 to the weights: The plunger 22 of the pump piston apparatus 2 is lifted (see FIGS. 8 & 9) to draw fluid from the oil accumulation chamber A into the front working chamber D via the first oil passage F (hydraulic oil pushes open the steel ball 345), and simultaneously to draw hydraulic oil from the rear oil accumulation chamber E into the front working chamber D via the oil hole 224 and the steel ball 225, thereafter the plunger 22 of the pump piston apparatus 2 is moved in an opposing direction thereby compressing the hydraulic fluid and moving same out of the front working chamber D into the rapid-lifting oil chamber C through the second oil passage G. Because the lifting tube 13 does not bear any weights at this time, the rapid-lifting oil chamber C which has a relatively smaller cross section is selected to extend the lifting tube 13, and therefore the lifting tube 13 can be rapidly moved to the bottom side of the weights. During rapid-lifting of the lifting tube 13 as above, the high-pressure oil chamber B becomes a chamber exhibiting negative pressure, therefore hydraulic oil is sucked from the oil accumulation chamber A to the high-pressure oil chamber B via the third oil passage H (see FIG. 12) for further working upon the next downward stroke of the pump piston apparatus plunger 22. Upon downstroke of the pump piston apparatus plunger 22 to squeeze hydraulic oil out of the front working chamber D, the rear oil accumulation chamber E is in negative pressure status, therefore hydraulic oil is sucked from the oil accumulation chamber A into the rear oil accumulation chamber E via the fourth oil passage I (see FIG. 13 and FIG. 16) for further quick supply of hydraulic oil to the front working chamber D during the next upstroke of the pump piston apparatus plunger 22.

Figure 14:
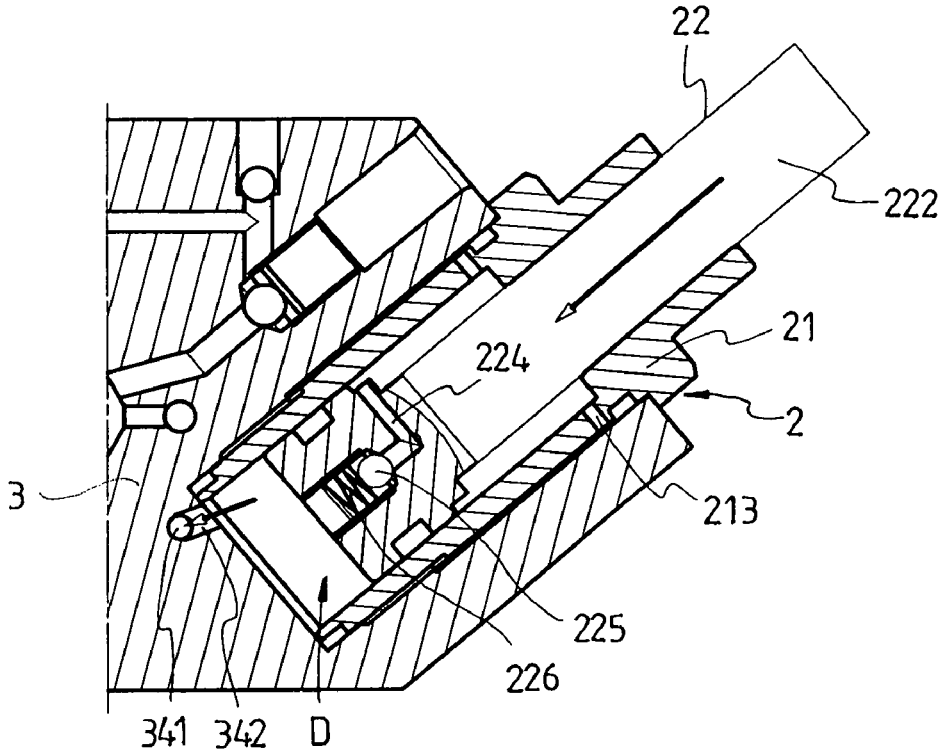
FIG. 14 is a schematic drawing showing hydraulic oil pumped into the second oil passage according to the present invention.
Figure 15:
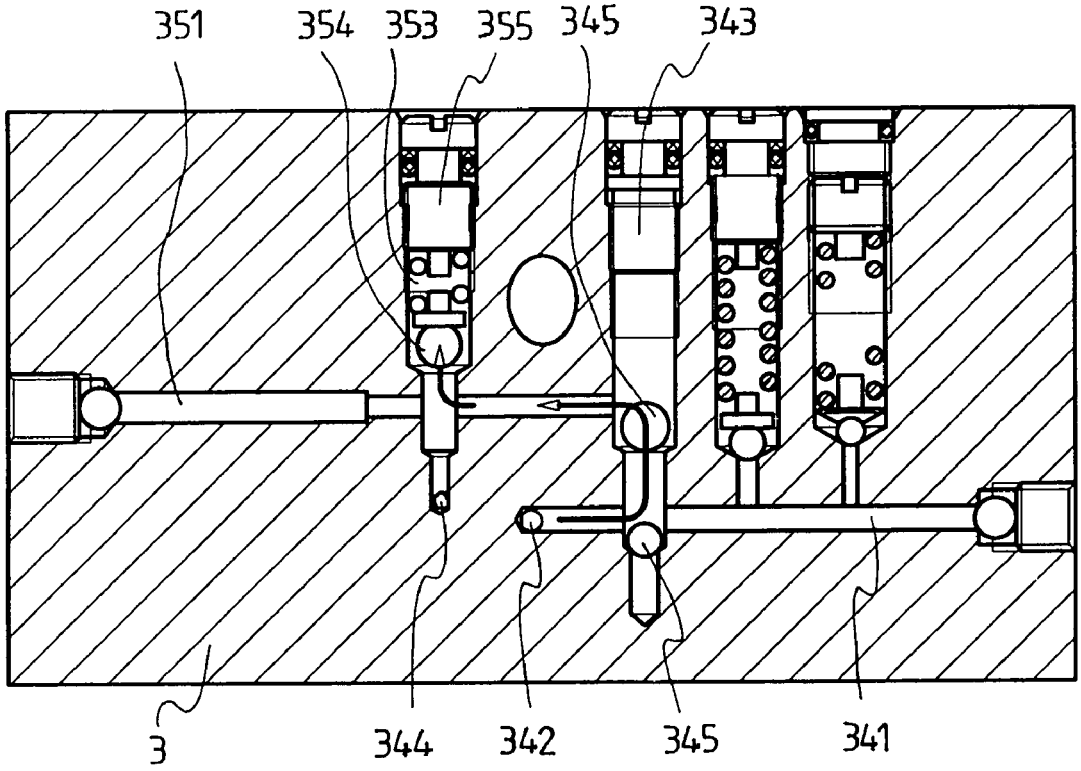
FIG. 15 is a schematic drawing showing hydraulic oil pumped into the high-pressure oil chamber according to the present invention.

2. Second stage, i.e., the lifting action of the lifting tube 13 to raise substantially lesser than rated capacity weights: Repeating the pumping action of the pump piston apparatus plunger 22 (see FIGS. 14 and 15) to fill up the front working chamber D with hydraulic oil. Because the lifting tube has ceased further extension upon reaching the weights, a downstroke of the pump piston apparatus plunger 22 causes hydraulic oil to pass from the second oil passage G into the high-pressure oil chamber B via the steel ball 354 and the pressure regulator 355, and therefore the high-pressure oil chamber B which has a relatively greater cross section is used to lift the lifting tube 13 to raise the weights. During the down stroke (compression stroke) of the pump piston apparatus plunger 22 to squeeze hydraulic oil out of the front working chamber D, the rear oil accumulation chamber E is changed to a negative pressure status therefore hydraulic oil is sucked from the oil accumulation chamber A into the rear oil accumulation chamber via the fourth oil passage I (see FIGS. 13 and 16) for further quick supply of hydraulic oil to the front working chamber D during the next upstroke of the pump piston apparatus plunger 22.

Figure 17:
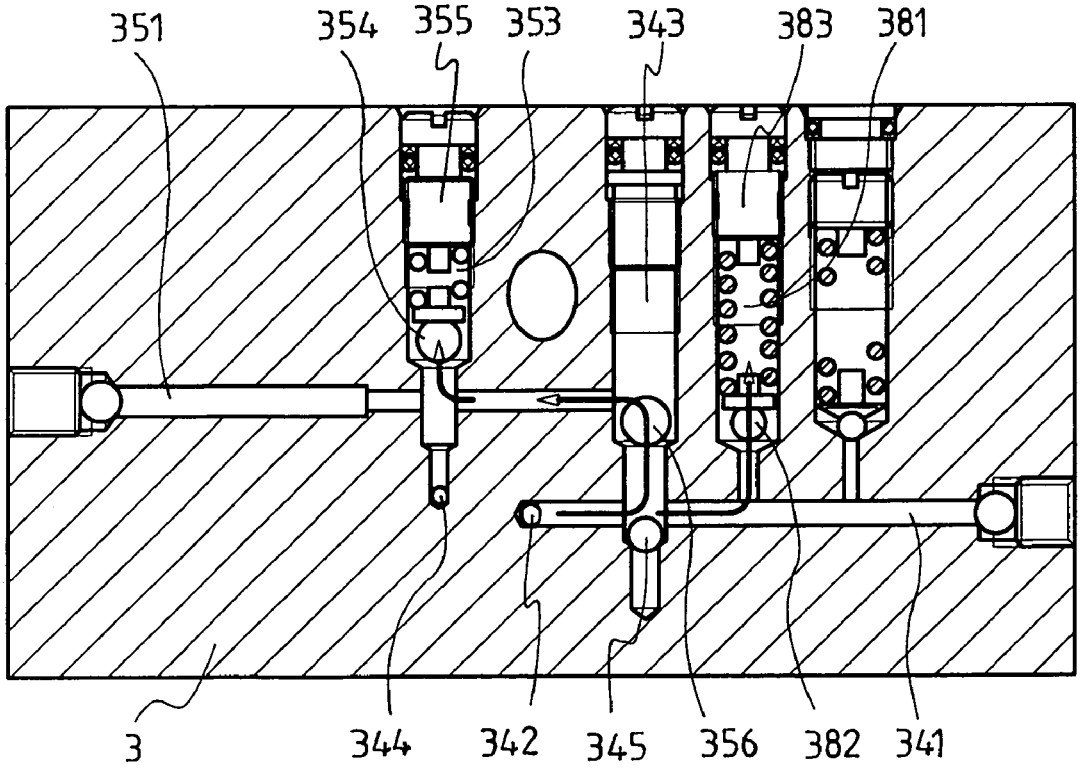
FIG. 17 (does not appear to be right) is a schematic drawing showing hydraulic oil shunted into the rear oil accumulation chamber upon an overload at the lifting tube according to the present invention.

3. Third stage, i.e., the lifting action of the lifting tube beyond the preset of pressure regulator 355: Repeating the action of pump piston apparatus plunger 22 (see FIGS. 16 and 17) to fill up the front working chamber D with hydraulic oil. Upon downstroke of plunger 22 after the front working chamber D has been filled with hydraulic oil, hydraulic oil is forced into the high-pressure oil chamber B to extend the lifting tube 13. If the weight is beyond the preset of pressure regulator 355 at this time, a quantity of hydraulic oil pumped by pump piston apparatus plunger 22 is shunted from the second oil passage G to the fifth oil passage I (see FIG. 17) and then to the rear oil accumulation chamber E in the pump piston apparatus 2 (see FIG. 16), and a quantity of hydraulic oil pushes open the steel ball 354 and the pressure regulator 365 and then to the high-pressure oil chamber B to extend the lifting tube 13 (see FIG. 17) and further raise the weights at a lesser rate of ascent than 2nd stage level and a substantially reduced operator effort. During return stroke of the lifting tube 13 to lower the weights, hydraulic oil passes from the high-pressure oil chamber B and the rapid-lifting oil chamber C to the oil accumulation chamber A via the seventh oil passage L and the sixth oil passage K respectively, enabling the lifting tube 13 to be lowered.

A prototype of three-stage lifting mechanism has been constructed with the features of FIGS. 1~18. The three-stage lifting mechanism functions to provide all of the features discussed earlier.

Although a particular embodiment of the invention has been described in detail for purposes of illustration, various modifications and enhancements may be made without departing from the spirit and scope of the invention. Accordingly, the invention is not to be limited except by the appended claims.

What is claimed is:

1. A load dependent, variable displacement, at least three-shift hydraulic device comprising:

a hydraulic device, said hydraulic device comprising a cylindrical casing, a barrel, a ram piston, and a small center tube, said casing being a double open end cylinder, said barrel being a double open end member axially inserted into the inside of said casing and defining with said casing an oil accumulation chamber in between said casing and said barrel, said ram piston being a one open side tube axially mounted in said barrel and forwardly extended out of said casing and adapted to lift weights, said ram piston having an axial center hole axially extended to a rear open side thereof, a piston ring disposed at the periphery thereof near the rear open side and bearing upon an inside wall of said barrel, and a high-pressure oil chamber defined within said barrel behind said piston ring, said small center tube being a double open side tube inserted into the axial center hole inside said ram piston and defining therein a rapid-lifting oil chamber;

a pump piston apparatus adapted to pump hydraulic oil into said hydraulic device to extend said ram piston, said pump piston apparatus comprising a housing, piston axially slidably mounted in said housing, said housing being a hollow cylindrical member having at least one oil hole positioned through the periphery thereof in communication with the inside space thereof, said plunger comprising a piston of relatively bigger diameter disposed at a front side inside said housing and a piston rod of relatively smaller diameter disposed at a rear side and extended out of said housing, said piston having a plurality of annular flanges extended around the periphery thereof and bearing upon an inside wall smaller diameter disposed at a rear side and extended out of said housing, said piston having a plurality of annular flanges extended around the periphery thereof and bearing upon an inside wall of said housing and defining the inside space of said housing into a front working chamber and a rear oil accumulation chamber, said piston having an oil hole axially backwardly extended from the center of the front side thereof and then directed sideways to the periphery thereof in communication between said front working chamber said rear oil accumulation chamber, and a one-way valve means formed of a spring member and a steel ball and mounted in the oil hole of said piston to control one-way flowing of hydraulic oil from said rear oil accumulation chamber; and a valve block adapted to accommodate said hydraulic device and said pump piston apparatus, said valve block comprising front coupling flange fitted into a rear open side of said cylindrical casing, a recessed portion disposed at the center of said front coupling flange and adapted to accommodate said barrel and said small center tube, a rear receiving hole adapted to accommodate said pump piston apparatus and to block said front working chamber, a first oil passage extended from said oil accumulation chamber to said front working chamber, a second oil passage extended from said front working chamber to said high-pressure oil chamber and said rapid-lifting oil chamber, a third oil passage extended from said oil accumulation chamber to said high-pressure oil chamber, a fourth oil passage extended from said oil accumulation chamber to said rear oil accumulation chamber, a fifth oil passage shunted from said second oil passage and extended to said rear oil accumulation chamber, a sixth oil passage extended from said rapid-lifting oil chamber to said oil accumulation chamber, and a seventh oil passage extended from said high-pressure oil chamber to said oil accumulation chamber.

2. The load dependent, variable displacement, at least three-shift hydraulic mechanism of claim 1, wherein said first oil passage is formed of a first transverse oil hole, an oil hole extended from a bottom end of said first transverse oil hole to said rear receiving hole, a stepped first longitudinal oil hole extended across first transverse oil hole, an oil hole extended from a bottom end of said stepped first longitudinal oil hole to a front side of said valve block in communication with said oil accumulation chamber, and a one-way valve formed of a steel ball and mounted in said stepped first longitudinal oil hole and stopped between the oil hole, which extends from said first transverse oil hole to said rear receiving hole, and the oil hole, which extends from said stepped first longitudinal oil hole to said oil accumulation chamber.

3. The load dependent, variable displacement, at least three-shift hydraulic mechanism of claim 1, wherein said second oil passage is formed of a second transverse oil hole in fluid communication with said first longitudinal oil hole, an oil hole extended from said second transverse oil hole to said rapid-lifting oil chamber, a second longitudinal oil hole extended across said second transverse oil hole, a steel ball mounted in said second longitudinal oil hole and working as a one-way valve means, a pressure regulator disposed at a top end of said second longitudinal oil hole, an oil hole extended from said second longitudinal oil hole to said high-pressure oil chamber, a steel ball mounted in said first longitudinal oil hole between said first transverse oil hole and said second transverse oil hole and working as one-way valve means.

4. The load dependent, variable displacement, at least three-shift hydraulic mechanism of claim 1, wherein said third oil hole passage comprises an angled oil hole extended from a front side of said front coupling flange of said valve block to said recessed portion, a steel ball mounted in said angled oil hole and working as a one-way valve means.

5. The load dependent, variable displacement, at least three-shift hydraulic mechanism of claim 2, wherein said fourth oil passage comprises an oil hole shunted from said first longitudinal oil hole below the steel ball in said first longitudinal oil hole, a third longitudinal oil hole disposed inside said valve block and across the oil hole shunted from said first longitudinal oil hole, an oil hole extended from said third longitudinal oil hole to said rear receiving hole, and a steel ball mounted in said third longitudinal oil hole and working as one-way valve means.

6. The load dependent, variable displacement, at least three-shift hydraulic mechanism of claim 2, wherein said fifth oil passage formed of a fourth longitudinal oil hole in fluid communication with said first transverse oil hole, a steel ball mounted in said fourth longitudinal oil hole and working as one-way valve means, a pressure regulator mounted in said fourth longitudinal oil hole above the steel ball in said fourth longitudinal oil hole, and an oil hole in fluid communication between said fourth longitudinal oil hole and said third longitudinal oil hole.

7. The load dependent, variable displacement, at least three-shift hydraulic mechanism of claim 1, wherein said sixth oil passage is formed of an oil hole disposed at said recessed portion of said valve block, a steel ball mounted in the oil hole at said recessed portion and working as one-way valve means for enabling hydraulic oil to pass from said rapid-lifting oil chamber to said oil accumulation chamber, a pressure regulator mounted in the oil hole of said sixth oil passage above the corresponding steel ball, an oil hole in fluid communication with the oil hole at said recessed portion and said oil accumulation chamber.

8. The load dependent, variable displacement, at least three-shift hydraulic mechanism of claim 1, wherein said seventh oil passage is an oil hole having one-way valve means mounted therein to control the flowing direction of hydraulic oil, for enabling hydraulic oil to flow backwards from said high-pressure oil chamber to said oil accumulation chamber via seventh oil passage upon return stroke of said ram piston.

* * * * *